US007172660B2

(12) United States Patent
Song et al.

(10) Patent No.: US 7,172,660 B2
(45) Date of Patent: Feb. 6, 2007

(54) METHOD FOR MAKING FE-BASED AMORPHOUS METAL POWDERS AND METHOD FOR MAKING SOFT MAGNETIC CORE USING THE SAME

(75) Inventors: Yong Sul Song, Seoul (KR); Jae Hwa Hong, Seoul (KR); Hie Jin Kim, Kimpo-si (KR)

(73) Assignee: Amosense Co., Ltd., Kyungki-do (KR)

( * ) Notice: Subject to any disclaimer, the term of this patent is extended or adjusted under 35 U.S.C. 154(b) by 394 days.

(21) Appl. No.: 10/683,393

(22) Filed: Oct. 14, 2003

(65) Prior Publication Data

US 2005/0028889 A1 Feb. 10, 2005

(30) Foreign Application Priority Data

Aug. 6, 2003 (KR) ..... 10-2003-0054445

(51) Int. Cl.
*H01F 1/153* (2006.01)
*H01F 1/22* (2006.01)

(52) U.S. Cl. ..... 148/104; 148/105

(58) Field of Classification Search ..... None
See application file for complete search history.

(56) References Cited

U.S. PATENT DOCUMENTS

| | | | | |
|---|---|---|---|---|
| 4,385,944 | A * | 5/1983 | Hasegawa | 148/104 |
| 4,985,089 | A * | 1/1991 | Yoshizawa et al. | 148/303 |
| 5,278,377 | A * | 1/1994 | Tsai | 219/759 |
| 5,509,975 | A * | 4/1996 | Kojima et al. | 148/104 |
| 5,741,373 | A * | 4/1998 | Suzuki et al. | 148/306 |
| 6,594,157 | B2 * | 7/2003 | Yoshida et al. | 363/14 |

* cited by examiner

*Primary Examiner*—John P. Sheehan
(74) *Attorney, Agent, or Firm*—Rosenberg, Klein & Lee

(57) ABSTRACT

A method for making an amorphous soft magnetic core using Fe-based amorphous metal powders is provided. The amorphous soft magnetic powders are obtained by crushing amorphous ribbons produced using a rapid solidification process (RSP). The magnetic core is obtained by performing a preliminary thermal treatment of amorphous metal ribbons made of Fe-based amorphous metal alloy using RSP, crushing the amorphous metal ribbons to thereby obtain amorphous metal powders, classifying the amorphous metal powders to then be mixed into a distribution of powder particles having an optimal uniform composition, mixing the mixed amorphous metal powders with a binder, forming a core, and annealing the formed core to then coat the core with an insulating resin.

2 Claims, 3 Drawing Sheets

METHOD FOR MAKING FE-BASED AMORPHOUS METAL POWDERS AND METHOD FOR MAKING SOFT MAGNETIC CORE USING THE SAME

BACKGROUND OF THE INVENTION

1. Field of the Invention

The present invention relates to a method for making an amorphous soft magnetic core using Fe-based amorphous metal powders, and more particularly, to a method for making amorphous metal powder by crushing amorphous ribbons produced using a rapid solidification process (RSP), which possesses an excellent direct-current overlapping characteristic at a flow of large current and an excellent core loss, and a method for making an amorphous soft magnetic core by using the amorphous metal powders.

2. Description of the Related Art

In general, a Fe-based amorphous soft magnetic body which is used as a conventional high-frequency soft magnetic body has a high saturation magnetic flux density (Bs), but has a low magnetic permeability, a large magnetic deformation, and an inferior high-frequency characteristic. A Co-based amorphous soft magnetic body has a low saturation magnetic flux density and a drawback of an expensive raw material. In case of an amorphous soft magnetic alloy, it is difficult to shape it in the form of a strip, and is limited to form a product of a toroidal shape. Since a ferrite soft magnetic body has a low high-frequency loss and a small saturation magnetic flux density, it is difficult to accomplish a compact product. Both of the amorphous and ferrite soft magnetic body has bad reliability in thermal stability due to a low crystallization temperature.

An amorphous ribbon fabricated by a rapid solidification process (RSP) is wound to then be used as a soft magnetic core. In this case, the soft magnetic core has a remarkably low direct-current overlapping characteristic and a remarkably low high-frequency characteristic, as well as an inferior core loss. This is because a powder core product has an effect of uniformly distributing an air gap by forming an insulating layer between powder particles, but has no air gaps in the case of an amorphous ribbon wound core. Thus, a core which is formed by using an amorphous ribbon in order to improve a direct-current overlapping characteristic, has a thin gap. In this case, an efficiency is lowered and an electromagnetic wave can be influenced to other electronic products and the human body, due to a leakage flux produced from the gap.

Soft magnetic cores which are used in choke coils for suppressing or smoothing electronic noise are manufactured in a manner that ceramic insulation materials are coated on magnetic metal powder such as pure iron, Fe—Si—Al alloy (referred to as "Sendust" hereinbelow), Ni—Fe—Mo Permally (referred to as "MPP (Moly Permally Powder)" hereinbelow), and Ni—Fe Permally (referred to as "High Flux" hereinbelow), and then forming lubricants are added on the coated metal powder, to then be formed by pressure and thermally treated.

In the conventional art, an insulation layer is formed between powder particles during making a soft magnetic core, to thereby uniformly distribute an air gap. Accordingly, an Eddy current loss sharply increasing at high-frequency is minimized, and the air gap is maintained in whole, to thereby accomplish an excellent direct-current overlapping characteristic at large current.

For example, a pure iron powder core is used for a choke coil in a switching mode power supply (SMPS) having a switching frequency of 50 kHz or lower, in order to suppress electronic noise generated by overlapping high-frequency current. A "Sendust" core is used as a core for a secondary smoothing choke coil or noise suppression in a SMPS having a switching frequency of a range from 100 kHz to 1 MHz.

MPP and "High Flux" cores are used at a frequency range equal to that of the "Sendust" core, and have a more excellent direct-current overlapping characteristic and a lower core loss characteristic than those of the "Sendust" core, but have a drawback that the cores are expensive.

Recently, the soft magnetic core requires more complicated characteristics according to compactness, integration, and high reliability of a switching mode power supply (SMPS).

The characteristics required for a smoothing choke coil in a SMPS are proper inductance L, a low core loss and an excellent direct-current overlapping characteristic.

Here, a direct-current overlapping characteristic is a magnetic core characteristic with respect to a waveform formed by feeble alternating-current, generated during converting an alternating-current input of a power supply into a direct-current, on which direct-current is overlapped. In the case that direct-current is overlapped over alternating-current, a core magnetic permeability is lowered in proportion with the direct-current. Here, the direct-current overlapping characteristic is estimated in a ratio (% μ-percent permeability) represented as a direct-current overlapping permeability with respect to a permeability at the state where direct-current is not overlapped, Thus, a variety of metal powder is employed in making a smoothing choke core in a SMPS (Switching Mode Power Supply) in various forms for each use, considering a price, a core loss, a direct-current overlapping characteristic, and a core size.

SUMMARY OF THE INVENTION

The inventors have recognized the above-described defects of the conventional art, and completed a method for making an amorphous soft magnetic core according to the present invention, considering that a Fe-based amorphous soft magnetic body has a high saturation magnetic flux density, and a high economy, and a processing cost can be reduced and a product of a complicated shape can be made in the case that the Fe-based amorphous soft magnetic body is made into powder.

To solve the above problems, it is an object of the present invention to provide a method for making Fe-based amorphous metal powders and a method for making an amorphous soft magnetic core using the Fe-based amorphous metal powders in which the amorphous soft magnetic powder is obtained by crushing amorphous ribbons produced using a rapid solidification process (RSP), which possesses an excellent direct-current overlapping characteristic at a flow of large current and an excellent core loss.

It is another object of the present invention to provide a method for making an amorphous soft magnetic core in which Fe-based amorphous metal powders having a high composition uniformity and a low oxidation level is obtained by crushing amorphous ribbons produced using a rapid solidification process (RSP), and a soft magnetic core is made by using the Fe-based amorphous metal powders, which can be employed widely in the field of requiring for an excellent direct-current overlapping characteristic at a flow of large current having an adverse use condition and in the field of making a smoothing choke core in a switching mode power supply (SMPS).

To accomplish the above object of the present invention, there is provided a method for making an amorphous soft magnetic core having an excellent direct-current overlapping characteristic as well as an inexpensive price, by using a Fe-based amorphous metal ribbon produced using a rapid solidification process (RSP), in which the well-known Fe-based amorphous alloy comprising Fe as a basic composition and at least one metalloid element selected from the group consisting of P, C, B, Si, Al and Ge as an auxiliary element.

According to one aspect of the present invention, there is provided an amorphous soft magnetic core making method comprising the steps of: performing a preliminary thermal treatment of amorphous metal ribbons made of Fe-based amorphous metal alloy using a rapid solidification process (RSP); crushing the amorphous metal ribbons to thereby obtain amorphous metal powders; classifying the amorphous metal powders to then be mixed into a distribution of powder particles having an optimal uniform composition; mixing the mixed amorphous metal powders with a binder, and then forming a core; and annealing the formed core to then coat the core with an insulating resin.

BRIEF DESCRIPTION OF THE DRAWINGS

The above and other objects and advantages of the present invention will become more apparent by describing the preferred embodiment thereof in more detail with reference to the accompanying drawings in which.

DETAILED DESCRIPTION OF THE INVENTION

A method for making an amorphous soft magnetic core according to a preferred embodiment of the present invention will be described below with reference to the accompanying drawings FIGS. 1 through 3.

Figure 1:
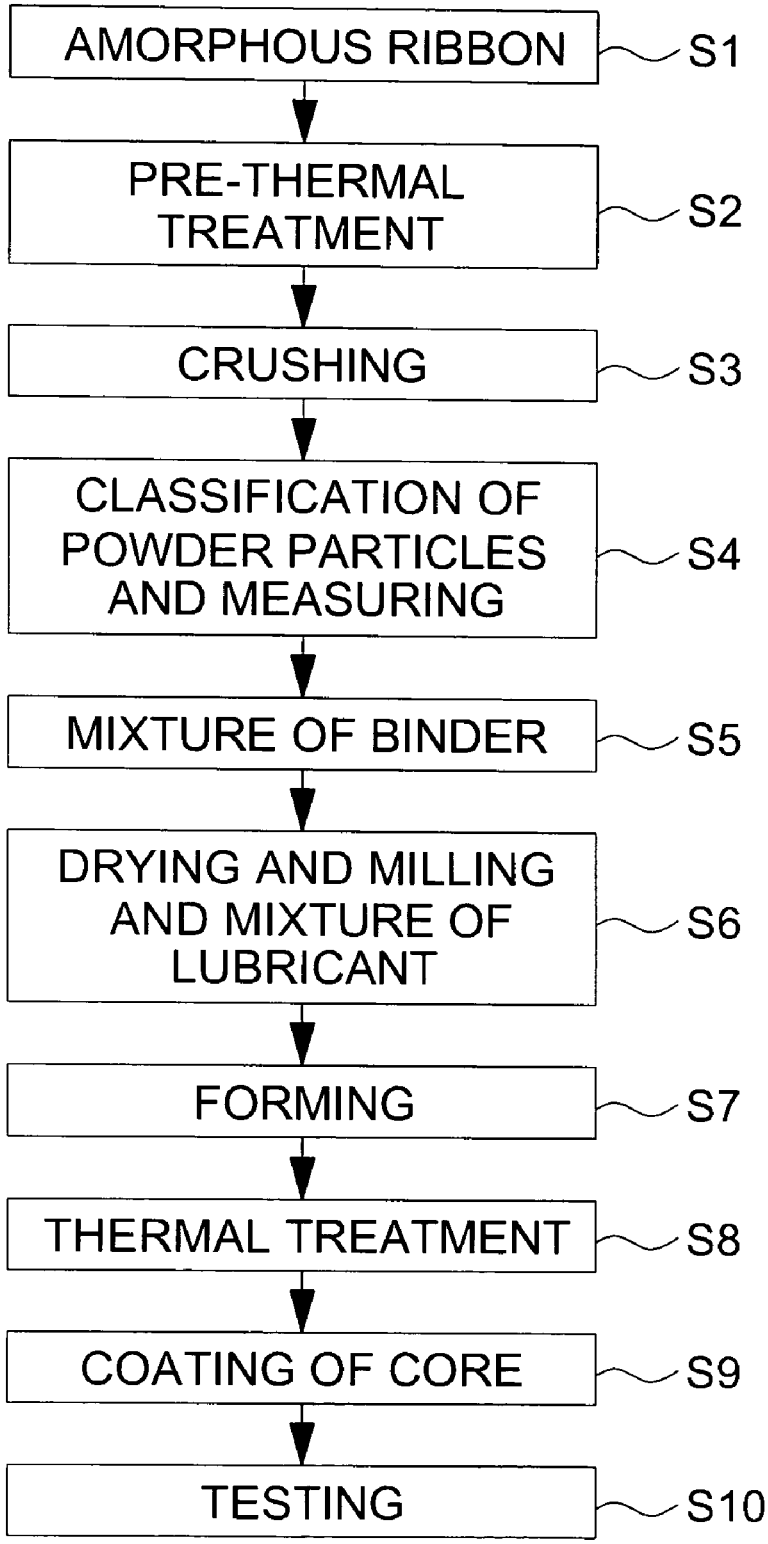
FIG. 1 is a flowchart view illustrating a series of processes of from making amorphous metal powders to forming an inductor according to the present invention.

Referring to FIG. 1 illustrating a series of processes of from making amorphous metal powders to forming an inductor according to the present invention, an amorphous metal ribbon produced by a rapid solidification process (RSP) is preliminarily thermally treated more than one hour at a temperature of 100 to 400° C. under the atmosphere in order to obtain Fe-based amorphous metal powders, and thereafter a step of crushing the Fe-based amorphous metal ribbon proceeds (steps S1 and S2).

The reason of setting the temperature into the range from 100 C to 400° C. in performing the thermal treatment is because there is no thermal treatment effect at a temperature of 100° C. or lower, and even the inner portion of the amorphous metal ribbon can be crystallized at a temperature of 400° C. or higher.

The preliminary thermal treatment does not affect on a metal powder characteristic and results in enhancing a crushing efficiency by 20% to 30%. Since the metal powder obtained by using the physical crushing process has a composition uniformity and a low oxidation level in comparison with metal powder obtained by a general fluid spraying process, a product made by using the metal powder obtained in the present invention has an excellent uniformity. That is, the method of obtaining metal powders according to a crushing process of the present invention solves a problem of causing products to be deteriorated during mass-production due to lowering of the uniformity of the powder obtained by the conventional fluid spraying process.

After having obtained the amorphous metal ribbon having undergone the preliminary thermal treatment, amorphous metal powder can be obtained by crushing the amorphous metal ribbon in a crusher (step S3). If a crushing condition during crushing, that is, a crushing speed and a crushing time are properly set, various types of powder having a variety of powder particles, a variety of shapes, and an irregular atomic arrangement state can be produced.

Thereafter, the crushed amorphous metal powder has undergone a powder classification process, and thus is classified into powder having passed through a sieve of −100~+140 meshes and one having passed through a sieve of −140~+200 meshes (S4).

A preferable distribution of powder particles used in the present invention includes powder having passed through a sieve of −100~+140 meshes of 35~45%, and one having passed through a sieve of −140~+200 meshes of 55~65%. This is a composition ratio of powder particles for obtaining the most optimal physical characteristic and compositional uniformity. In the case of the preferable composition, the amorphous metal powder shows the highest density of about 80~82%.

The reason why a distribution of particles of metal powder is set to include powder having passed through a sieve of −100~+140 meshes of 35~45%, and one having passed through a sieve of −140~+200 meshes of 55~65%, is because a desired magnetic permeability cannot be obtained if powder having passed through a sieve of −100~+140 meshes is used by 35% or less, and a targeted featured core cannot be obtained due to a crack caused during forming if powder having passed through a sieve of −100~+140 meshes is used by 45% or more. Then, in order to manufacture the amorphous metal powder fabricated as described above into a soft magnetic core, phenol, polyimide or epoxy of 0.5 wt %~2 wt % is mixed as a binder (S5), to then perform drying. The drying process uses a solvent when the phenol, polyimide or epoxy is mixed, in order to dry the phenol, polyimide or epoxy. After having dried, a lump of powder works on a milling to then be re-crushed.

A lubricant selected from the group consisting of Zn, ZnS, and stearate is added in the powder re-crushed after a milling work, and then mixed (S6). Then, a toroidal core is formed with a forming pressure of about 20~26 ton/cm', by using a press machine (S7). The lubricant is used in order to reduce a frictional force between the powder particles or between a formed body and a mold. It is preferable that a generally used Zn-stearate is mixed by 2 wt % or less.

Then, the toroidal core formed as described above is thermally treated, that is, annealed under the atmosphere at a temperature of 300~500 ° C., to thereby remove remaining tension and deformation (S8). Thereafter, in order to protect a characteristic of a core from the moisture and atmosphere, polyester or epoxy resin is coated on the surface of the core, to thereby manufacture a soft magnetic core (S9). Here, it is preferable that the thickness of the epoxy resin coating layer is generally 50~200 μm or so.

Hereinbelow, the present invention will be described in more detail through embodiments.

Embodiment 1

An amorphous ribbon having a composition of $Fe_{78}$—$Si_{13}$—$B_9$ produced using a rapid solidification process (RSP), has been thermally treated for one hour at 300° C. under the atmosphere, to thereby obtain a preliminarily thermally treated amorphous metal ribbon. After crushing the amorphous metal ribbon by using a crusher, powder having passed through a sieve of −100~+140 meshes of 40%, and powder having passed through a sieve of −140~+200 meshes of 60% have been obtained through a classification of the powder particles.

Then, the produced amorphous metal powder has been mixed with phenol of 1.5 wt %, to then be dried. After having dried, the powder having been mixed with the phenol of 1.5 wt % has been again crushed by using a ball mill, and then Zn-stearate of 0.5 wt % has been added to and mixed with the crushed powder. Thereafter, the powder having been mixed with the Zn-stearate has been formed with a forming pressure of 24 ton/cm' by using a core mold, to thereby produce a toroidal core.

Thereafter, the core formed body has undergone an annealing process for 30 minutes at a temperature of 450 ° C. and then epoxy resin has been coated on the surface of the core with a thickness of 100 μm, to then measure a magnetic permeability, a direct-current overlapping characteristic, and a core loss characteristic, which is illustrated in the following Table 1.

Also, in Table 1, "Sendust" 1 and "Sendust" 2 available in the market are used as the conventional materials 1 and 2 for comparison with the present invention material, respectively. The values which are obtained by measuring characteristics with respect to the toroidal core are given from those written in catalogs provided by each company. The "Sendust" 1 and "Sendust" 2 are crystal metal made of Fe—Al—Si alloy, in which "Sendust" 1 is a product by Magnetics Company, and "Sendust" 2 is a product by ChangSung Corporation in Korea.

A magnetic feature is estimated as follows.

Enamel copper wire has been wound by thirty turns, and then inductance L (μH) of the thirty turns of the enamel copper wire has been measured by using a precise LCR meter. Then, a magnetic permeability (μ) has been obtained by a relationship of a toroidal core, that is, $L=(0.4\pi\mu N^2 A\times 10^{-2})/l$). Here, N denotes the number of turns, A denotes the sectional area of the core, and l denotes an average length of magnetic paths. Measuring conditions are a frequency of 100 kHz, an alternating-current (AC) voltage of 1V and the state where direct-current (DC) is not overlapped, that is, $I_{DC}=0$ A.

Also, a direct-current value is changed, change in a magnetic permeability is measured, and a direct-current (DC) overlapping characteristic is tested. Here, measuring conditions a frequency of 100 kHz, an alternating-current (AC) voltage of IV and a measurement magnetization intensity ($H_{DC}$) of 20 Oe. Here, peak magnetization current (I) is calculated by an equation, that is, $H_{DC}=0.4\pi NI/l$.

A core loss is measured by a B—H analyser. Primary and secondary windings are wound by thirty turns and five turns, respectively, and then measured.

A magnetic permeability, a direct-current overlapping characteristic, and a core loss characteristic, are compared with those of the conventional material, in the following Table 1.

TABLE 1

| | Magnetic permeability (μ) (100 kHz, 1 V) | DC overlapping characteristic (% μ) (50 Oe) | Core loss (mW/cm³) (100 kHz, 0.1 T) |
|---|---|---|---|
| The present invention | 60 | 84 | 1000 |
| Conventional 1 ("Sendust" 1) | 60 | 74 | 950 |
| Conventional 2 ("Sendust" 2) | 60 | 72 | 1100 |

Figure 2:
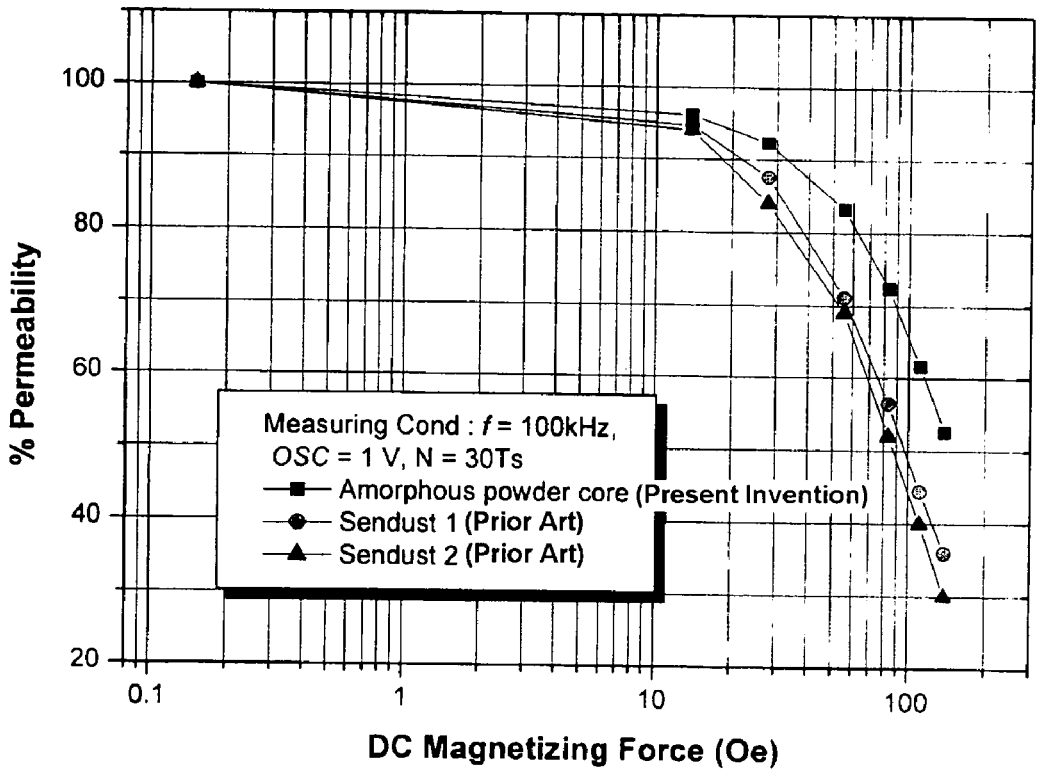
FIG. 2 is a graphical view illustrating a variation in a magnetic permeability according to a direct-current (DC) overlap at an inductance of 100 kH and a voltage of 1V, after forming.

As shown in FIG. 2, a soft magnetic core (■) produced by using an amorphous metal powder according to the present invention shows a direct-current (DC) overlapping characteristic higher than soft magnetic cores (●) and (▲) produced by the conventional method with the conventional "Sendust" 1 and "Sendust" 2.

Figure 3:
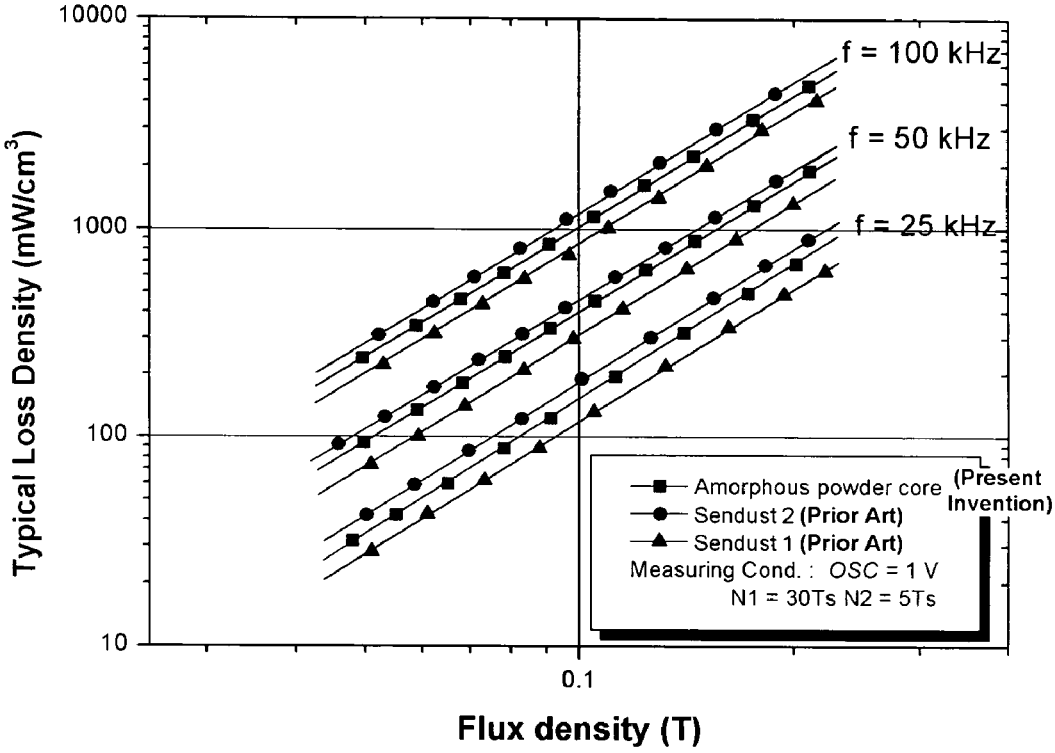
FIG. 3 is a graphical view illustrating a core loss at a respective frequency of 25 kHz, 50 kHz, and 100 kHz.

As shown in FIG. 3, a core loss in the present invention which is shown as symbol (■) is also not less than those of the conventional materials which are shown as symbol (▲) and symbol (●), respectively.

Embodiment 2

An amorphous ribbon has been produced in the same manner as that of EMBODIMENT 1. Powder having passed through a sieve of −100~+140 meshes of 70%, and powder having passed through a sieve of −140~+200 meshes of 30% have been used as powder particles of the amorphous metal powder. When a core has been formed through an extruding former, cracks have occurred on the surface of the core, after having formed the core. Thus, the core has been broken after having treated the core thermally.

If powder having passed through a sieve of −100~+140 meshes of 45% or more is used, it can be seen, from the experiments changing a distribution of powder particles of the metal powder, that cracks occur during forming and a core of a desired characteristic cannot be obtained.

Embodiment 3

An amorphous ribbon has been produced in the same manner as that of EMBODIMENT 1. Powder having passed through a sieve of −100~+140 meshes of 10%, and powder having passed through a sieve of −140~+200 meshes of 90% have been used as powder particles of the amorphous metal powder. When a magnetic feature is estimated after coating, a magnetic permeability was 45, which was lower by 20% than that of the core of EMBODIMENT 1 using powder having passed through a sieve of −100~+140 meshes of 40%, and powder having passed through a sieve of −140~+200 meshes of 60%.

If powder having passed through a sieve of −100~+140 meshes of 35% or less is used, it can be seen, from the experiments changing a distribution of powder particles of the metal powder, that a desired magnetic permeability cannot be obtained.

Embodiment 4

An amorphous ribbon has been produced in the same manner as that of EMBODIMENT 1. Contents of a binder have been used as 0.3%, 0.7%, 2%, and 2.5% in unit of weight%, respectively.

In the case of a core having produced by adding a binder of 0.3 wt % therein, an end capping phenomenon has occurred after having formed the core. The end capping phenomenon means that a formed surface has broken after forming, which generally occurs when a small number of contents of the binder exist.

Meanwhile, in the case of a core having produced by adding a binder of 3 wt %, a spring back phenomenon has occurred after having formed the core. The spring back phenomenon occurs when organic additives such as a binder or a lubricant are contracted by an acting pressure and then elastically restored by a released pressure. As a result, cracks can be formed, which generally occurs when a large number of contents of the binder exist.

Also, in the case of a core having produced by adding a binder of 0.7 wt % and 2 wt %, no big problems have happened.

Embodiment 5

An amorphous ribbon has been produced in the same manner as that of EMBODIMENT 1. At the time of performing an annealing process, the thermal treatment temperatures have been changed into 290, 300, 400, 500 and 510° C. and the thermal treatment time has been changed from ten minutes to eight hours. Table 2 shows a change in a magnetic permeability according to a thermal treatment temperature and a thermal treatment time.

TABLE 2

| Thermal treatment temperature (° C.) | Thermal treatment time (hr) | Magnetic permeability (100 kHz, 1 V) |
|---|---|---|
| 290 | 4.5 | 54 |
| 300 | 4.3 | 62 |
| 400 | 0.8 | 63 |
| 500 | 0.25 | 64 |
| 510 | 0.2 | 65 |

As can be seen from Table 2, a magnetic permeability of 60 or more can be realized at 300, 400 and 500° C. However, a magnetic permeability of 60 or more cannot be realized at 290 and 510° C. That is, it is preferable that an annealing process should be performed at a temperature of 300° C. or more and 500° C. or less.

As described above, a soft magnetic core is produced by using amorphous metal powders obtained by using a soft magnetic core obtained by using the well-known Fe-based amorphous metal ribbon as an original material having an inexpensive price and an excellent direct-current (DC) overlapping characteristic at large current. Accordingly, the soft magnetic core is relatively less expensive than the conventional MPP and Hiflux, and an excellent direct-current (DC) overlapping characteristic at large current.

Also, amorphous metal powders obtained by crushing amorphous ribbons produced using a rapid solidification process (RSP), in the present invention, has a higher composition uniformity and a lower oxidation level than powders produced by the conventional fluid spraying method. Further, a soft magnetic core is made by using the amorphous metal powders, which can be employed widely in the field of making a smoothing choke core in a switching mode power supply (SMPS), as well as in the field of requiring for an excellent direct-current overlapping characteristic at a flow of large current having an adverse use condition.

As described above, the present invention has been described with respect to particularly preferred embodiments. However, the present invention is not limited to the above embodiments, and it is possible for one who has an ordinary skill in the art to make various modifications and variations, without departing off the spirit of the present invention.

What is claimed is:

1. A method of making an amorphous soft magnetic core comprising the steps of:

performing a preliminary thermal treatment of amorphous metal ribbons of an Fe-based amorphous metal alloy produced by a rapid solidification process, the amorphous metal alloy comprising Fe as a basic composition and at least one element selected from the group consisting of P, C, B, Si, Al and Ge as an auxiliary element;

crushing the amorphous metal ribbons to thereby obtain amorphous metal powders;

classifying the amorphous metal powders to then be mixed into a distribution of powder particles made of first powders having passed through a sieve of −100~+140 meshes of 35~45%, and second powders having passed through a sieve of −140~+200 meshes of 55~65%;

mixing the mixed amorphous metal powders with a binder, and then forming a core; and annealing the formed core and then coating the core with an insulating resin.

2. The method of making a soft magnetic core of claim 1, wherein the annealing process is performed for 0.3 to 4.3 hours at a temperature of 300 to 500° C.

* * * * *